US011027407B2

(12) United States Patent
Butler et al.

(10) Patent No.: US 11,027,407 B2
(45) Date of Patent: Jun. 8, 2021

(54) ROTATING GRIP FOR A PNEUMATIC TOOL

(71) Applicant: VIS, LLC, Travelers Rest, SC (US)

(72) Inventors: Sam Butler, Anderson, SC (US); Katherine Mruz, Simpsonville, SC (US); Patrick S. Livingston, Easton, PA (US); Billy R. Lee, Jr., Moore, SC (US)

(73) Assignee: VIS, LLC, Travelers Rest, SC (US)

( * ) Notice: Subject to any disclaimer, the term of this patent is extended or adjusted under 35 U.S.C. 154(b) by 120 days.

(21) Appl. No.: 16/178,747

(22) Filed: Nov. 2, 2018

(65) Prior Publication Data

US 2020/0139530 A1 May 7, 2020

(51) Int. Cl.

| | |
|---|---|
| ***B25F 5/02*** | (2006.01) |
| ***B25B 21/02*** | (2006.01) |
| ***B25G 1/06*** | (2006.01) |
| ***B25B 23/14*** | (2006.01) |
| ***B25G 1/10*** | (2006.01) |
| ***B25B 23/147*** | (2006.01) |

(52) U.S. Cl.

CPC ..... *B25F 5/02* (2013.01); *B25B 21/023* (2013.01); *B25B 23/1405* (2013.01); *B25B 23/1475* (2013.01); *B25G 1/06* (2013.01); *B25G 1/102* (2013.01)

(58) Field of Classification Search

USPC ..... 173/170; 279/19.4, 75, 81; 403/357

See application file for complete search history.

(56) References Cited

U.S. PATENT DOCUMENTS

| | | | | | |
|---|---|---|---|---|---|
| 2,372,029 | A * | 3/1945 | Stair | B25D 9/08 | 173/31 |
| 2,432,144 | A * | 12/1947 | Elkins | B25D 17/08 | 279/19.4 |
| 3,298,284 | A * | 1/1967 | Alexander | B23G 1/16 | 418/270 |
| 3,331,268 | A * | 7/1967 | Jones | B25B 21/002 | 81/55 |
| 4,231,581 | A * | 11/1980 | Benedict | B23B 31/1071 | 279/19.4 |
| 9,636,813 | B2 * | 5/2017 | Rose | B25C 1/188 | |

* cited by examiner

*Primary Examiner* — Nathaniel C Chukwurah

(74) *Attorney, Agent, or Firm* — J. Bennett Mullinax, LLC

(57) ABSTRACT

An air tool comprising a barrel; a main body portion from which the barrel extends; a sleeve secured to an exterior of the barrel, the sleeve connected to the barrel by a retaining ring wherein the sleeve provides for a gripping location by an operator and wherein the retaining ring facilitates rotation of the sleeve relative to the barrel when the tool is operation.

12 Claims, 3 Drawing Sheets

ROTATING GRIP FOR A PNEUMATIC TOOL

FIELD OF THE INVENTION

This invention is directed towards a sleeve secured to a portion of a barrel of an air hammer, air gun or similar pneumatic tool and process of using the hand tool.

BACKGROUND OF THE INVENTION

Pneumatic tools such as impact wrenches, socket wrenches, and similar tools are frequently used by automotive repair technicians. Frequently, the tool needs to be positioned and maneuvered into a preferred orientation or rapidly repositioned from one location to a second location during a repair job. Such positioning typically involves repositioning the tool relative to the user's support hand which is positioned about the barrel of the air tool. For extended use, the repetitive movement and placement of the air tool requires a frequent adjustment and rotation with respect to the operator's support hands. This can create both operator fatigue as well as contribute to a longer time interval of situating and resituating the tool. Within the context of a professional, frequent user of such tools, the constant manipulation of the tool and the tool orientation can create fatigue and be time consuming. Accordingly, there remains room for variation and improvement within the art.

SUMMARY OF THE INVENTION

It is one aspect of at least one of the present embodiments to provide for a cylindrical sleeve positioned on an exterior portion of a barrel of an air tool which allows rotation of the air tool relative to the sleeve.

It is a further object of at least one embodiment of the present invention to provide an air tool with a rotatable sleeve secured to a barrel of the air tool where the sleeve is cylindrical.

It is a further object of at least one embodiment of the present invention to provide an air tool with a rotatable sleeve secured to a barrel of the air tool where the sleeve is tapered.

It is a further object of a least one embodiment of the present invention to provide a new and improved air tool in which the air tool has a rotatable sleeve along an longitudinal axis of the air tool, the sleeve secured to the air tool by a retaining ring defined along a barrel of the air tool.

It is a further object of at least one embodiment of the present invention to provide for a sleeve on an air tool that is secured to a longitudinal portion of the air tool by a retaining ring in which the retaining ring provides for an effective amount of rotational resistance between the sleeve and the air tool.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
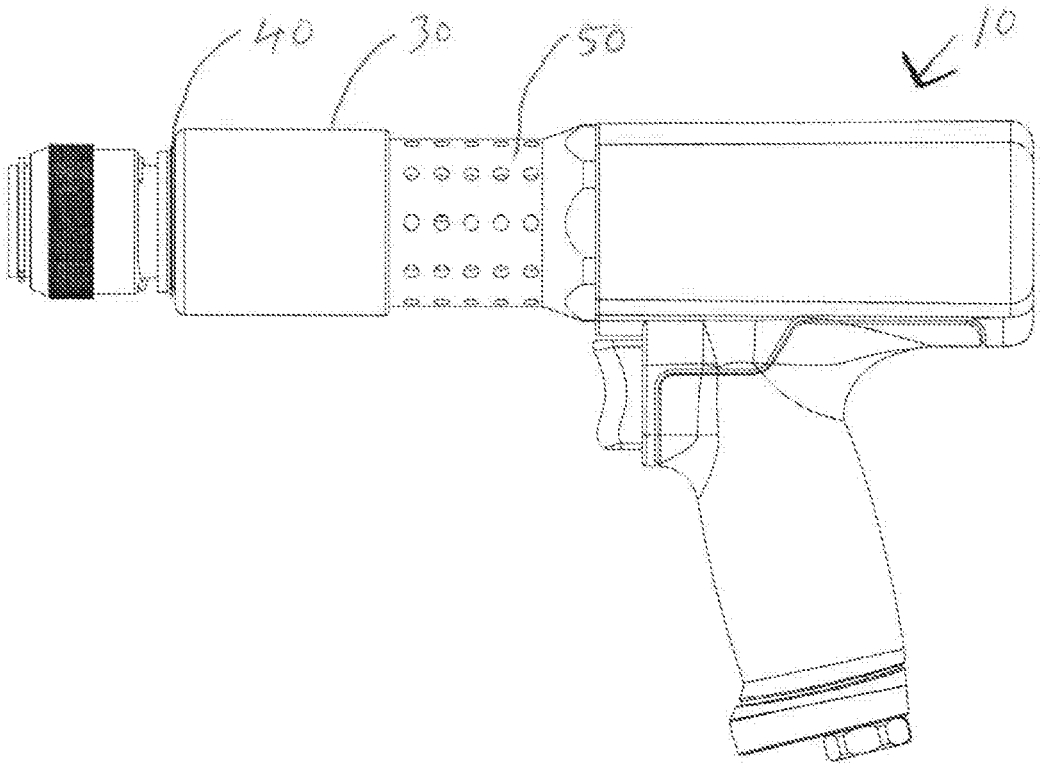
FIG. 1 is a perspective view of one embodiment of an air tool with a rotating sleeve.
Figure 2:
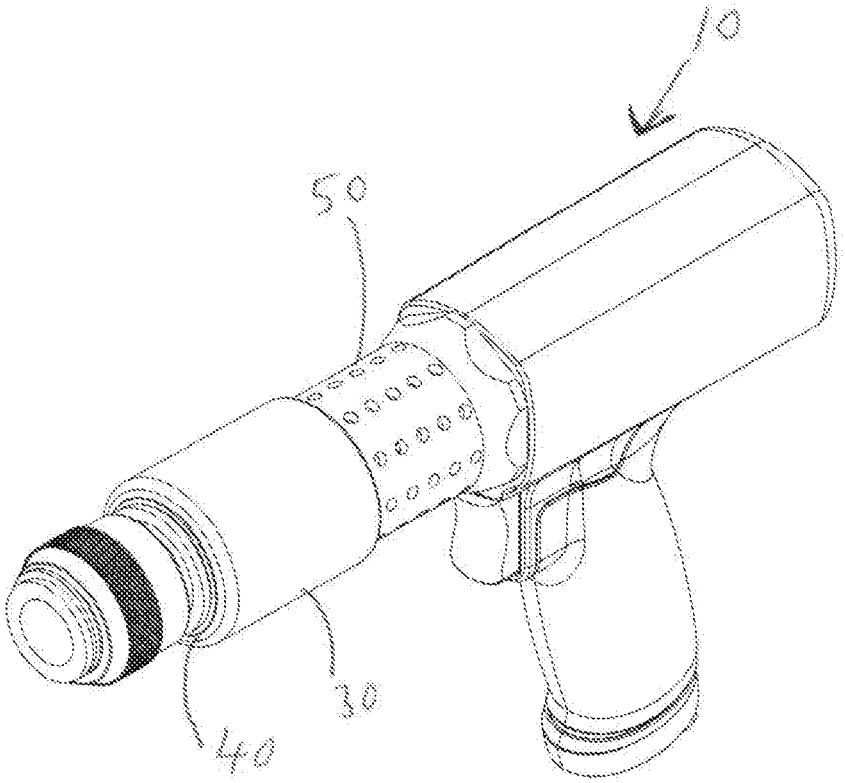
FIG. 2 is a side view of the air tool seen in FIG. 1.
Figure 3:
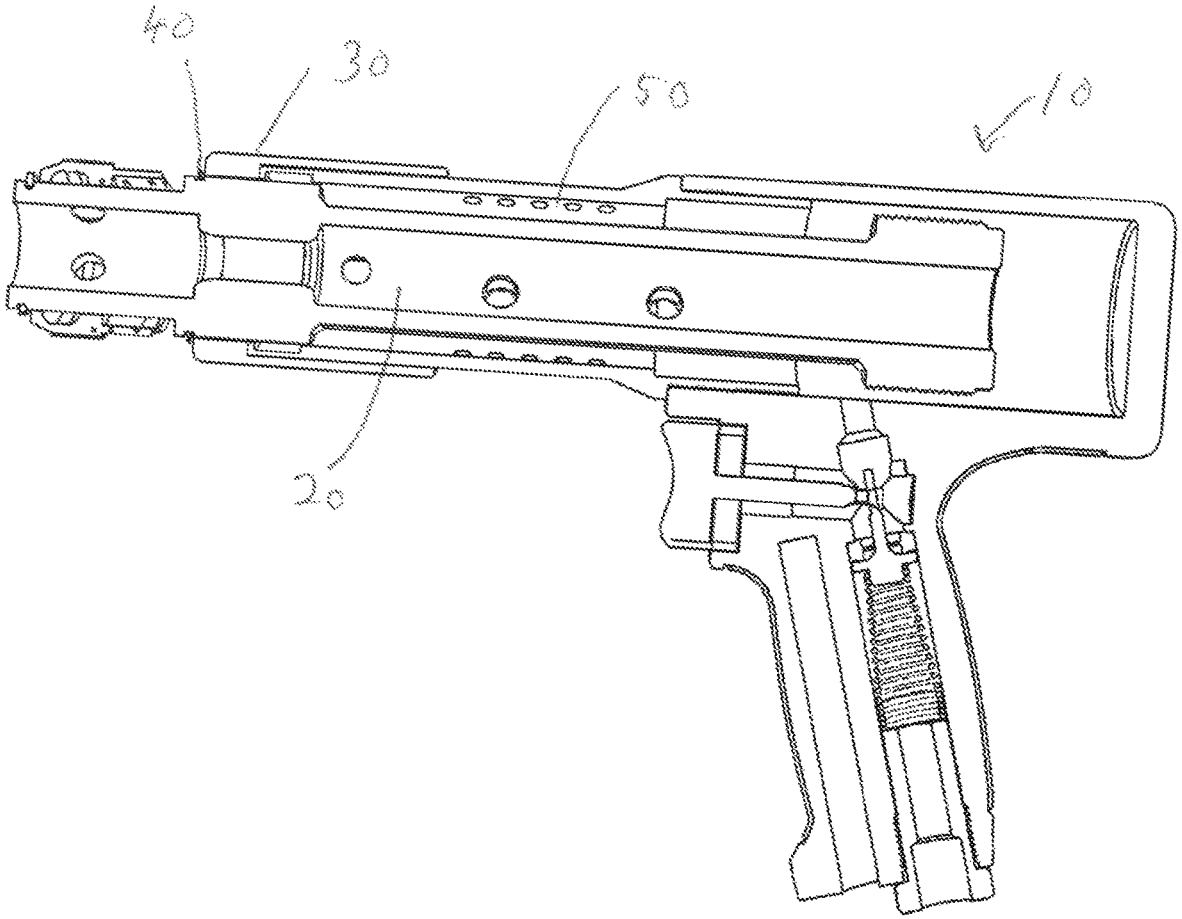
FIG. 3 is a cross sectional view along line 3-3 of FIG. 2.

As set forth in FIGS. 1-3, a tool gun 10 is illustrated having a cylindrical barrel portion 20 (FIG. 3) extending from the main body of the air tool surrounding the barrel 20 and exhaust deflector 50 is an exhaust deflector 50. A rotatable sleeve 30 is secured along an exterior of barrel 20 and is designed to rotate via an attachment to a retaining ring 40. FIG. 1 illustrates one embodiment of the retaining ring 40 positioned on barrel 20 near a first end of the rotatable sleeve 30. While the retaining ring 40 is illustrated positioned near one end of the sleeve 30, other configurations are possible where the retaining ring is positioned along any suitable interior portion of sleeve 30.

Preferably, the tension provided between the retaining ring 40 and sleeve 30 provides sufficient resistance to rotation such that a user can easily rotate the tool relative to the sleeve 30 but the resistance is sufficient enough to prevent the "free wheeling" or too low of a resistance force.

Alternatives to a retaining ring for the rotational arrangement between the sleeve and the barrel of the air tool are also possible including the use of a groove on the barrel which interacts with a mated projection defined by the sleeve.

One advantage of the rotatable sleeve 30 with respect to the air tool 10 is that it helps eliminate operator fatigue when using the tool for extended periods of time and or with repetitive motion. The rotating sleeve allows the operator to secure the hand tool and also move the main body of the tool in order to accommodate tight spaces within the tool environment. In addition, the rotating sleeve provides an additional margin of safety when using the air tool should an unexpected resistance or torque be experienced that might create an unexpected rotation of the barrel relative to the operator's hand. Absent the rotating sleeve, the tool could move suddenly within the operator's hand causing loss control of the tool or injury. With the rotating sleeve, the unexpected movement does not effect the securement of the tool when the collar is engaged by the operator.

As seen in FIGS. 1-3, one embodiment of the rotatating sleeve 30 is in the form of a cylinder and in which a longitudinal axis of the air tool barrel is aligned with a longitudinal axis of the sleeve. It is envisioned that other shapes of the sleeve can be provided including variations where the exterior of the sleeve may define a taper that facilitates gripping by the operator. In addition, the exterior of the sleeve can be textured or constructed of a cushioning material that provides a more comfortable grip. It is also envisioned that the rotatable sleeve can be in the form of an ergonomic grip that facilitates engagement by the operator's hand but still rotates relative to the barrel of the air tool.

As further seen in reference to FIGS. 1-3, the exhaust deflector 50 may be opposite an exterior surface of the barrel. When an exhaust deflector 50 is present, the sleeve 30 would be positioned directly opposite the corresponding portion of the deflector 50. In some embodiments, the interior of the sleeve may physically engage one of a surface of either the barrel exterior or the deflector exterior.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained therein.

That which is claimed:

1. An air tool comprising:

a barrel;

a main body portion from which the barrel extends;

a sleeve secured to an exterior of the barrel, the sleeve connected to the barrel by a retaining ring, the retaining ring engaging an exterior terminal end of the sleeve, wherein the sleeve provides for a gripping location by an operator and wherein the retaining ring facilitates rotation of the sleeve relative to the barrel when the tool is in operation.

2. The air tool according to claim 1 wherein the sleeve is cylindrical.

3. The air tool according to claim 1 wherein the sleeve defines a taper along a length of the sleeve.

4. The air tool according to claim 1 further comprising an exhaust deflector positioned opposite an exterior of the barrel and further positioned opposite an interior surface of the sleeve.

5. The air tool according to claim 1 wherein the retaining ring is sealed within a groove, the groove being defined by a body portion of the air tool.

6. An air tool comprising:

a barrel portion comprising a sleeve positioned on an exterior portion of the barrel of the air tool, the sleeve being positioned within a groove defined on a body portion of the air tool and having a retaining ring therein, the retaining ring engaging an exterior terminal, end of the sleeve, thereby allowing rotation of the air tool relative to the sleeve.

7. The air tool according to claim 6 wherein the sleeve is secured to the barrel of the air tool by a retaining ring.

8. The air tool according to claim 6 further comprising an exhaust deflector positioned opposite an exterior of the barrel and further positioned opposite an interior surface of the sleeve.

9. An air tool comprising:

a barrel;

a main body portion from which the barrel extends;

a sleeve secured to an exterior of the barrel, the sleeve connected to the barrel by a retaining ring wherein the sleeve provides for a gripping location by an operator;

an exhaust deflector positioned opposite an exterior of the barrel and further positioned opposite an interior surface of the sleeve, and wherein the retaining ring facilitates rotation of the sleeve relative to the barrel when the tool is in operation.

10. The air tool according to claim 9 wherein the retaining ring is sealed within a groove, the groove being defined by a body portion of the air tool.

11. An air tool comprising:

a barrel portion comprising a sleeve positioned on an exterior portion of the barrel of the air tool, the sleeve allowing rotation of the air tool relative to the sleeve, the exterior of the barrel further comprising an exhaust deflector, an exterior surface of the exhaust deflector further positioned opposite an interior of the sleeve.

12. The air tool according to claim 11 wherein the retaining ring is sealed within a groove, the groove being defined by a body portion of the air tool.

* * * * *